US006860201B2

(12) United States Patent
Guillen et al.

(10) Patent No.: US 6,860,201 B2
(45) Date of Patent: Mar. 1, 2005

(54) PRINTING APPARATUS

(75) Inventors: Roberto Guillen, Barcelona (ES); Francisco Javier Pozuelo, Barcelona (ES); Francisco Guerrero, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/437,922

(22) Filed: May 15, 2003

(65) Prior Publication Data

US 2004/0003733 A1 Jan. 8, 2004

(30) Foreign Application Priority Data

May 17, 2002 (GB) ..... 0211246

(51) Int. Cl.[7] ..... B41F 13/54

(52) U.S. Cl. ..... 101/228; 101/219; 156/264; 347/104

(58) Field of Search ..... 101/228, 219, 101/216, 213, 92, 178; 156/264, 265, 268; 347/101–104

(56) References Cited

U.S. PATENT DOCUMENTS

| | | | | | |
|---|---|---|---|---|---|
| 4,147,104 | A | * | 4/1979 | Zernov et al. | 101/181 |
| 6,261,012 | B1 | * | 7/2001 | Haas et al. | 400/208 |
| 6,409,872 | B1 | * | 6/2002 | Campion et al. | 156/264 |
| 6,517,200 | B1 | * | 2/2003 | Ramaswamy et al. | 347/104 |
| 6,520,080 | B1 | * | 2/2003 | Fried | 101/227 |
| 6,585,366 | B2 | | 7/2003 | Nagata et al. | |
| 2003/0126962 | A1 | * | 7/2003 | Bland et al. | 83/13 |

FOREIGN PATENT DOCUMENTS

| | | | | |
|---|---|---|---|---|
| GB | 2178392 A | * | 2/1987 | B31D/1/00 |

* cited by examiner

*Primary Examiner*—Minh Chau
(74) *Attorney, Agent, or Firm*—Foley & Lardner LLP

(57) ABSTRACT

Media printed in a printer is fed in an integrated operation to a laminator to be at least partly laminated, the media between the printer and the laminator device forming a loose media buffer. Synchronization is provided between the advance of the media in the printer and in the laminator. This is done preferably using counting devices associated to the printer and the laminator, or buffer shape sensors, or control indicia on the media. The apparatus may perform a resetting operation of the media buffer.

22 Claims, 9 Drawing Sheets

PRINTING APPARATUS

BACKGROUND OF THE INVENTION

The applicant has developed an apparatus which is able to laminate plots that are outputted by a printing device, in a continuous operation. A media, such as a continuous web of paper, is printed in a printing device and then it may be fed to an integrated laminator device so that at least some of the printed plots are laminated.

In such an apparatus it is advisable to avoid the need of frequent user intervention, and of course it is advisable to minimize defects in the printed and laminated plots, for example printing defects due to tension on the media being printed or defects in the alignment between a printed plot and the application of a lamination film thereon.

These requirements are especially important in the case of large format apparatus, i.e. apparatus which are able to handle media widths of 600 mm (24 inches) or more, due to heavy use and high media cost.

DESCRIPTION OF THE INVENTION

According to an aspect of the present invention, a printing apparatus comprises a printer and a laminator device, in which media that advances and is printed in the printer is subsequently fed in an integrated operation to the laminator device and advanced therethrough to laminate at least part of the media, wherein the media between the printer and the laminator device forms a loose media buffer, the apparatus further comprising synchronization means between the advance of the media in the printer and the advance of the media in the laminator device.

Provision of such synchronization avoids the need of frequent user intervention, and it facilitates the reduction of defects in the printed and laminated plots.

In one embodiment, the synchronization means comprise first counting means associated to the printer, second counting means associated to the laminator device, and control means to control the advance of the media in the laminator device in response to the readings of the first and second counting means. The first and second counting means may comprise encoders.

The counting means allow accuracy in the control of the buffer and of the moment when a certain point of the printed media reaches the laminator; furthermore, the control may work correctly for several kinds of media and inking conditions.

In an alternative embodiment, the synchronization means comprise buffer shape sensor means which provide a reading of a geometric variable associated with the shape of the media buffer, and control means to control the advance of the media in the laminator device in response to the reading of the buffer shape sensor means.

The buffer shape sensor means may comprise at least an arm having one end hinged to the apparatus and the other end in contact with the media buffer, and means to determine the angular position of the arm.

In a third embodiment, the synchronization means comprise means to provide control indicia on the printed media and means to detect the control indicia at the laminator device. The control indicia may be printed marks.

Preferably, the apparatus further comprises means for performing a resetting operation of the media buffer.

The resetting operation allows the build-up of errors in a length of media on; which several plots are printed to be minimised, and therefore improves the ability of the apparatus to work unattended.

The means for performing a resetting operation may comprise means for; reducing the loose media buffer to zero by arranging the media tight between the, printer and the laminator device; the means for reducing the loose media buffer to zero preferably comprise means for maintaining the media stationary in the printer and advancing it in the laminator device, and means for stopping the advance of the media in the laminator device when the loose media buffer has been reduced to zero.

In one embodiment of the invention, the means for stopping the advance of the media in the laminator device comprise sensor means arranged to sense the geometric shape of the media buffer; alternatively, they may comprise means arranged to detect a predetermined tension of the media.

One embodiment of the invention foresees that the means arranged to detect a predetermined tension of the media comprise a clutch associated to media take-up means.

In an alternative embodiment, the means arranged to detect a predetermined tension of the media comprise a current sensor associated to media driving means.

According to a second aspect, the present invention provides a method for printing and laminating a media comprising advancing media through a printer to print on it, feeding media that leaves the printer to a laminator device in an integrated operation, leaving a loose media buffer between the printer and the laminator device, and advancing the media through the laminator device to laminate at least part of the media, wherein the advance of the media in the printer and the advance of the media in the laminator device are synchronized.

In one embodiment, the synchronization comprises counting the media advance in the printer, counting the media advance in the laminator device, and controlling the advance of the media in the laminator device in response to the result of the countings.

Alternatively, the synchronization comprises sensing the buffer shape by detecting a geometric variable associated with the shape of the buffer, and controlling the advance of the media in the laminator device in response to the determined buffer shape.

In a third alternative embodiment, the synchronization comprises providing control indicia on the printed media and detecting the control indicia at the laminator device.

The method may also comprise the step of performing a resetting operation of the media buffer, which may be performed at intervals; preferably, when a plurality of plots are printed on the media, the resetting operation is performed before each plot is printed.

BRIEF DESCRIPTION OF THE DRAWINGS

Particular embodiments of the present invention will be described in; the following, only by way of nonlimiting example, with reference to the appended drawings in which.

DESCRIPTION OF PREFERRED EMBODIMENTS

Figure 1:
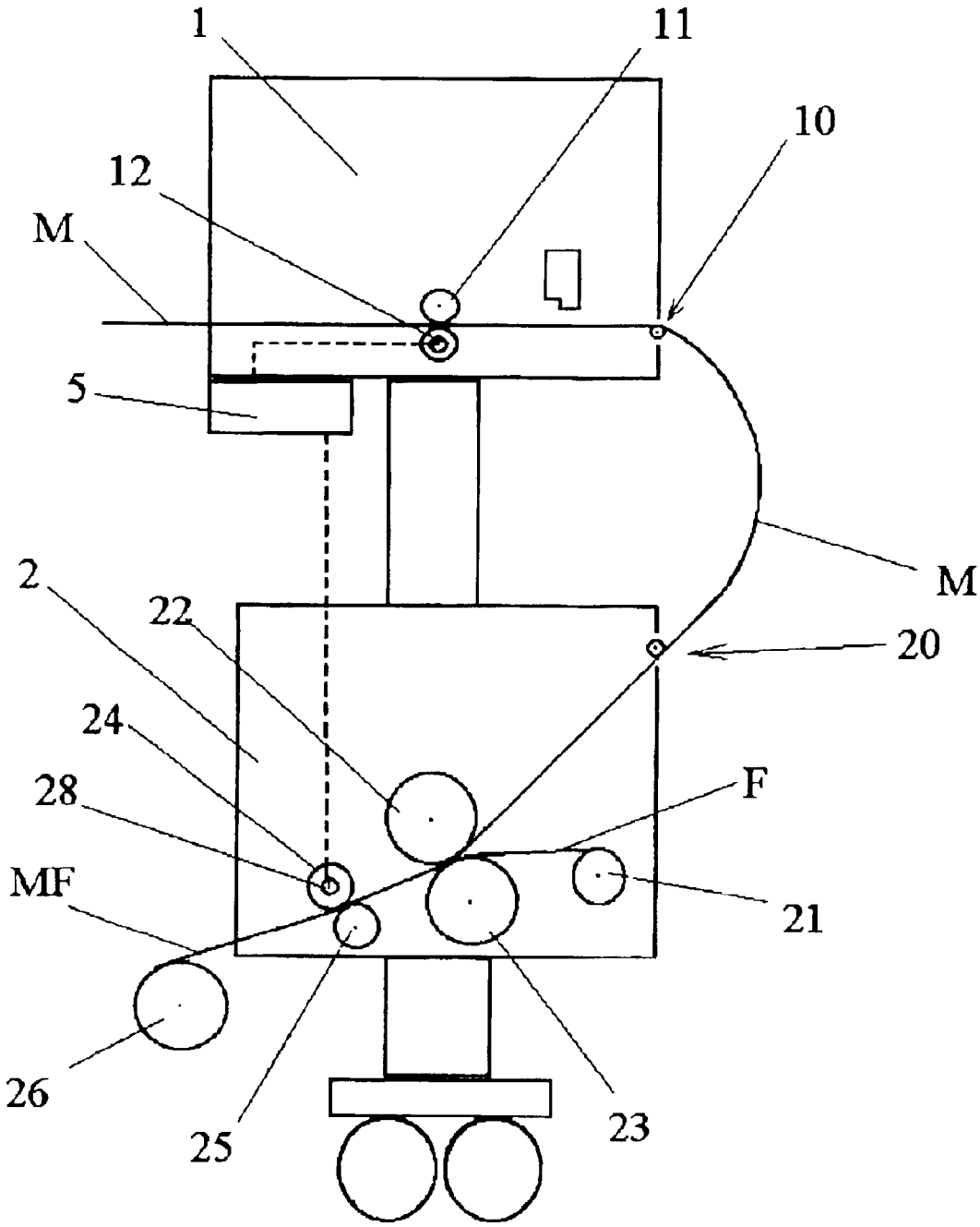
FIG. 1 is a schematic view in side elevation of a printing apparatus according to an embodiment of the present invention.

FIG. 1 shows an embodiment of the present invention in which a printing device 1, for example a large-format inkjet printer, is provided with a laminator device 2 in one integrated apparatus.

By 'integrated' apparatus it is here meant that the devices 1 and 2 may operate in succession, a media being able to pass from one device to the other, such that the media may be printed and thereafter laminated by the apparatus in a continuous operation, without normally requiring manual intervention. The laminating operation of a media, or of one plot printed on the media, may be started before its printing is finished, and therefore printing and laminating may be simultaneous.

This is particularly useful in the case of a large format apparatus, i.e. an apparatus which is able to handle media widths of 600 mm (24 inches) or more, since the length of the printed plots is generally in proportion to the width, or even bigger, and it is thus desirable to be able to start laminating before printing is over.

Starting laminating after the end of the printing operation would be slow and therefore not cost-effective, and would generate problems of media handling due to the length of printed media that would need to be stored and then fed to the laminator.

Furthermore, large-format apparatus are generally for professional, heavy use; it is thus also desirable that the apparatus can work substantially unattended.

On the other hand, in the case of a large format apparatus, handling of the media is more difficult due to media behaviour, and the cost of the media stresses the importance of avoiding its waste.

In the figure, a media M is printed in the printing device 1, which is provided with means 11 for the advance of the media, and leaves through the outlet 10, to be then fed to the laminator 2 through its inlet 20.

An embodiment of feeding means for feeding the media to the laminator, together with its operation and advantages, will be described later on with reference to FIGS. 6 to 12.

The media M will normally consist of a continuous web of paper or similar material, on which several plots are printed one after the other.

After printing each plot, the printer 1 stops for processing data, advances a small amount of media to separate two subsequent plots from each other, and starts printing the next plot.

The laminator 2 holds at least a roll 21 of a suitable film F; such a film F may comprise a layer of plastic material and a layer of thermally activable adhesive. There can also be a second roll of film (not shown), if it is desired to laminate both sides of the media.

The laminator 2 also comprises a pair of idle lamination rolls 22 and 23, which can also be referred to as a 'laminating nip', through which the media M and film F are conducted. Rolls 22 and 23 are suitable for applying pressure and heat to the media and film, in order to perform the laminating operation causing the film to adhere to the printed media.

Media lamination may also be performed by means of a cold lamination process, with a different type of film F and without providing heat through the laminating rolls.

Downstream of the lamination rolls, the laminated media MF is engaged by a pair of driving rollers 24,25 which make it advance through the laminator; downstream of these driving rollers, it is wound on a take-up reel 26.

The operation of the apparatus is thus as follows: media M printed and outputted by the printing device 1 is pulled into the laminator 2 by the driving rollers 24,25, and is laminated together with one or two films F by applying pressure and heat through the idle lamination rolls 22,23. The laminated media MF is then wound on the take-up reel 26.

In this process, according to the invention there is a control to ascertain when the leading edge of each plot to be laminated reaches the lamination rolls 22,23, and this control is exerted by implementing some kind of synchronization between the printer 1 and the laminator 2.

The utility of synchronization in the process arises mainly from two requirements, as explained in the following.

On one hand, the media between the printer and the laminator has to be left loose in order to avoid tensioning the media that is being printed in the printing device 1, because a tension could cause defects in the printed plot; this means that the media will form a buffer between the outlet of the printing device and the inlet of the laminator device.

On the other hand, this media buffer will not be constant in length, due to: the different speed profiles of the devices: while the printing operation is incremental, the media being advanced swath by swath and remaining stationary during printing, the advance of the media through the laminator may be varied within certain speed limits but cannot be stopped within one plot, because the lamination will normally be a thermally activated operation and a stop would cause defects in the finished product.

Even in the case of other kinds of lamination processes, e.g. cold lamination, it is advisable to synchronise the two devices in order to avoid tensioning the media during printing and to allow to laminate only certain plots, or to laminate at varying speeds.

According to the invention, the printing apparatus is provided with means for synchronizing the advance of the media in the printing device 1 and in the laminator device 2.

In FIG. 1, according to a first embodiment of the invention, the synchronization means control the length of the media buffer between the printing device and the laminator device by determining the advance of the media through the printer and through the laminator and using the data to calculate the position of any given point of the media.

The synchronization means comprise first counting means 12 to measure the media that advances through the printer 1, second counting means 28 to measure the media that advances through the laminator 2, and control means 5 which receive the input of the first and second counting means and control the advance of the media through the laminator device and the lamination operation accordingly.

The readings of the two counting means allow the control means 5 to determine the amount of buffer existing at each moment, and the position of the leading edge and of the trailing edge of each plotted is printed consequently, the control means may start and stop the laminating operation of each plot with accuracy and maintain the desired buffer length.

Furthermore, the control means 5 may adjust the speed of the laminating operation in order to maintain an appropriate buffer length at all times and thus avoid a pulling action on the media being printed.

Buffer control is also useful to avoid an excess of media between the printer and the laminator. Such an excess could cause a contact of the fresh printed face with a surface, and thus a defect in the printout, and could also change the angle at which the media enters the laminator; in this case, the angle may be inappropriate for correct introduction of the media between the laminating rolls.

The first and second counting means 12,28 may for example be encoders, respectively associated with the means 11 for advance of the media through the printer and with the lamination rolls 22,23 or the driving rollers 24,25 of the laminator.

Figure 2:
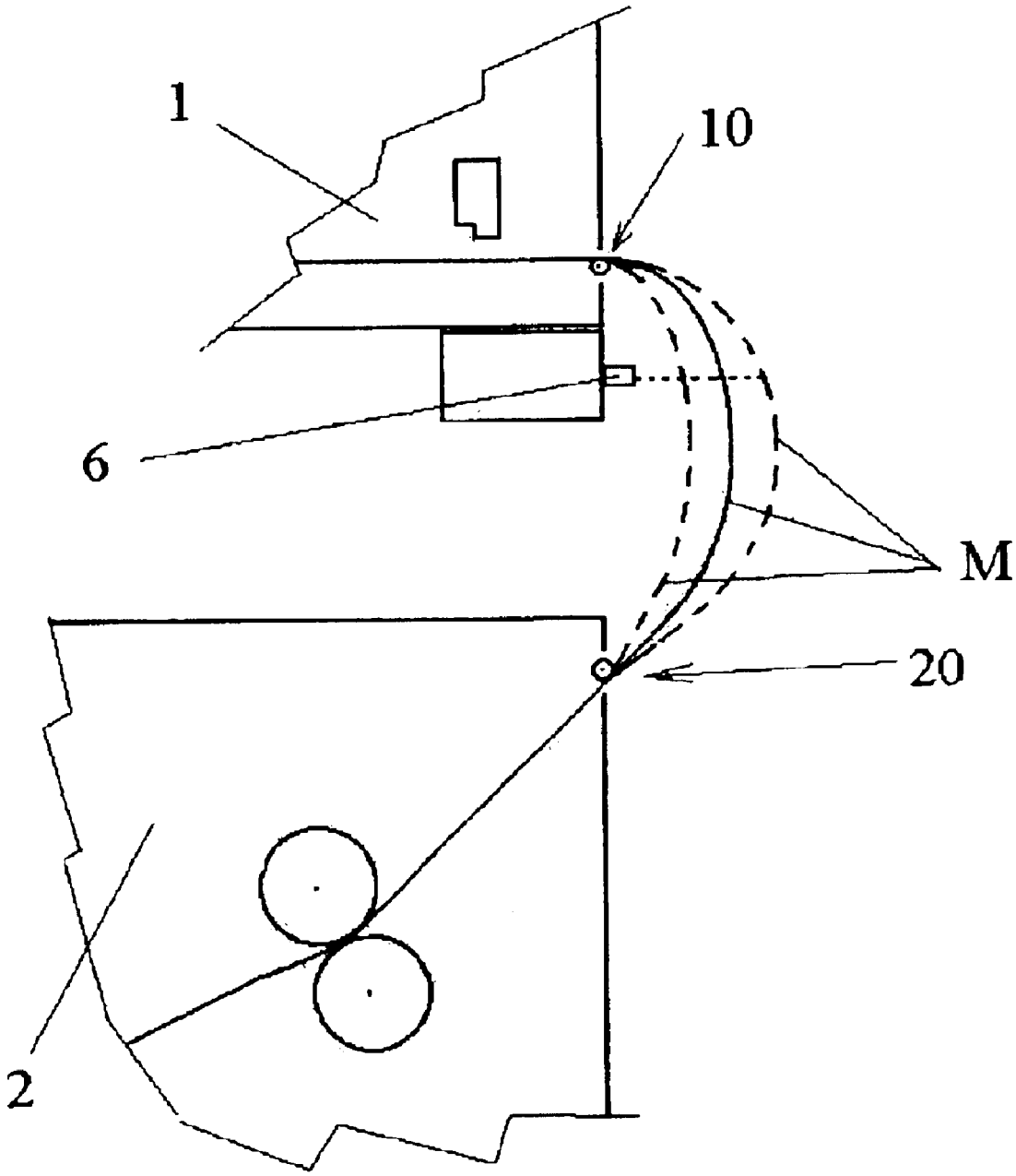
FIGS. 2 and 3 are partial views of two printing apparatus, according to two alternative embodiments.

FIG. 2 shows a detail of an alternative embodiment of the invention, in which the synchronization means are constituted by a proximity sensor 6 arranged near the path of the buffer formed by the media M: since the geometric shape of the media in the buffer region depends upon the length of the buffer, the reading of the sensor 6 will give an indication of this length. In FIG. 2 three different conditions of the media buffer are depicted, one in solid line and two in dotted lines: the figure shows clearly the change in the value measured by the proximity sensor.

The reading of the sensor 6 can thus be applied to determine when a given point of the printed media reaches the laminator. This point may be the leading edge or, the trailing edge of a plot, and the laminating operation can be controlled accordingly; similarly, the lamination speed can be varied depending on the reading of the proximity sensor 6, in order to increase or decrease the buffer length at will.

Further proximity sensors may be foreseen, in different points of the buffer region, in order to increase accuracy.

Figure 3:
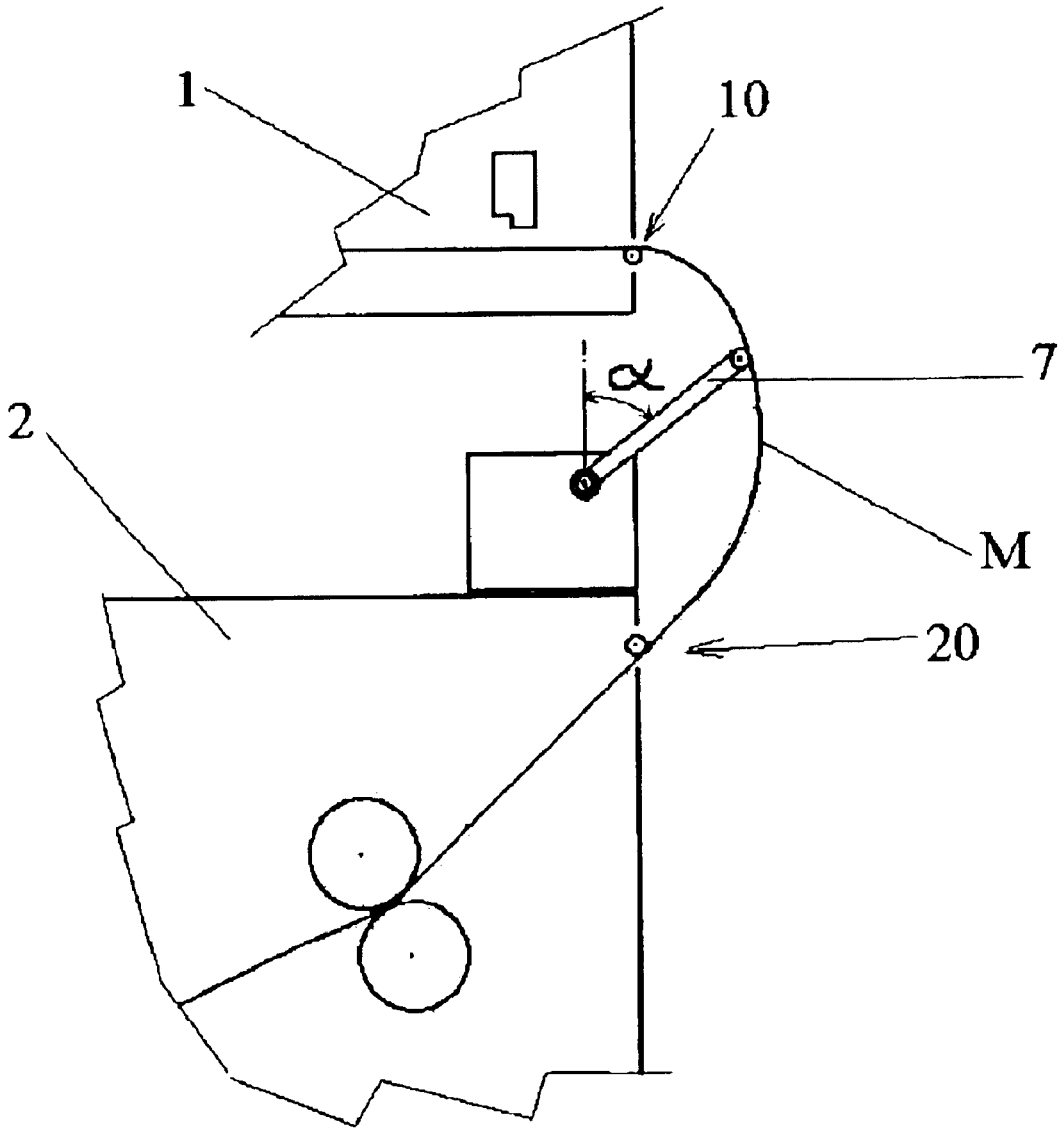

A variant of the synchronization means of FIG. 2 is shown in FIG. 3, where the length of the buffer is determined by means of an arm 7 having an end hinged to the apparatus and the other end resting slightly against the media in the buffer region; the angle $\alpha$ formed by the arm depends upon the shape of the buffer and thus upon its length, and its value can be used similarly to the reading of the proximity sensor in the embodiment of FIG. 2.

The arm 7 is designed to exert only a slight force on the media, in order to avoid any defects in the printing.

In a different embodiment the synchronization is carried out by providing control indicia on the media, e.g. in the form of printed marks at the beginning and at the end of each plot, and corresponding sensor means, e.g. an optical reading device (not shown), in the laminator 2 in order to read the indicia and allow to control the operation of the laminator accordingly.

Figure 4:
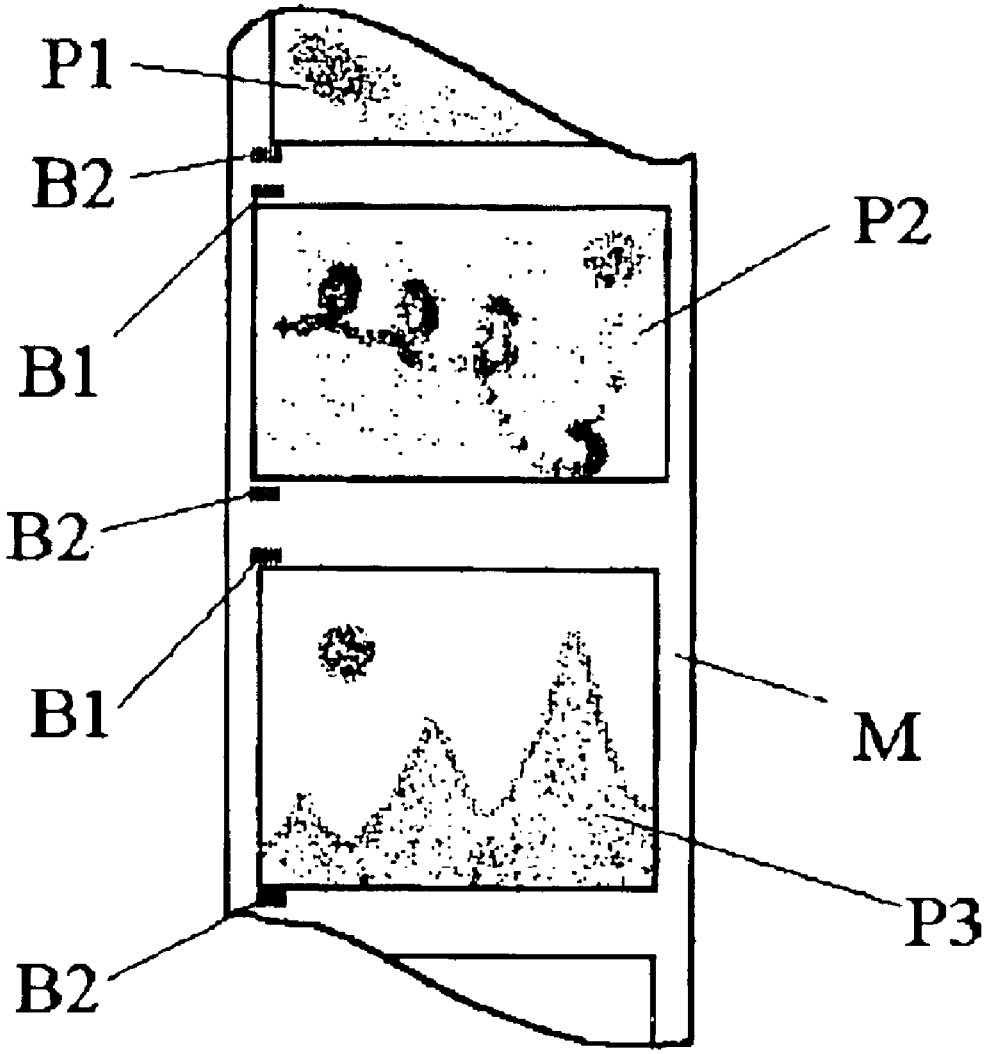
FIG. 4 shows a portion of a web of printed media bearing control indicia.

By way of example, FIG. 4 shows a length of media M on which bar codes have been printed along with the plots P1, P2, P3: a first bar code B1 indicates the leading edge of each plot, and a second bar code B2 indicates the trailing end of each plot. Other kinds of bar codes may be foreseen, e.g. to indicate plots that don't need to be laminated.

Other types of printed marks can be used, or even non-printed indicia, e.g. magnetic codes or optical indicia such as perforations.

When the synchronization between printer and laminator is carried out by means of encoders or similar counting means, the control means of the apparatus also need to know the length of the buffer at the beginning of the operation.

This length could be determined and inputted by the user at the beginning of the operation, or it can be a predetermined value; in the latter case, the user could adjust the media to this predetermined value with the aid of guide means or zero-setting means, for instance when a new roll of media is loaded in the apparatus.

However, according to embodiments of the present invention a resetting operation can be performed automatically by the apparatus, thus avoiding user intervention and allowing to improve accuracy.

Figure 5:
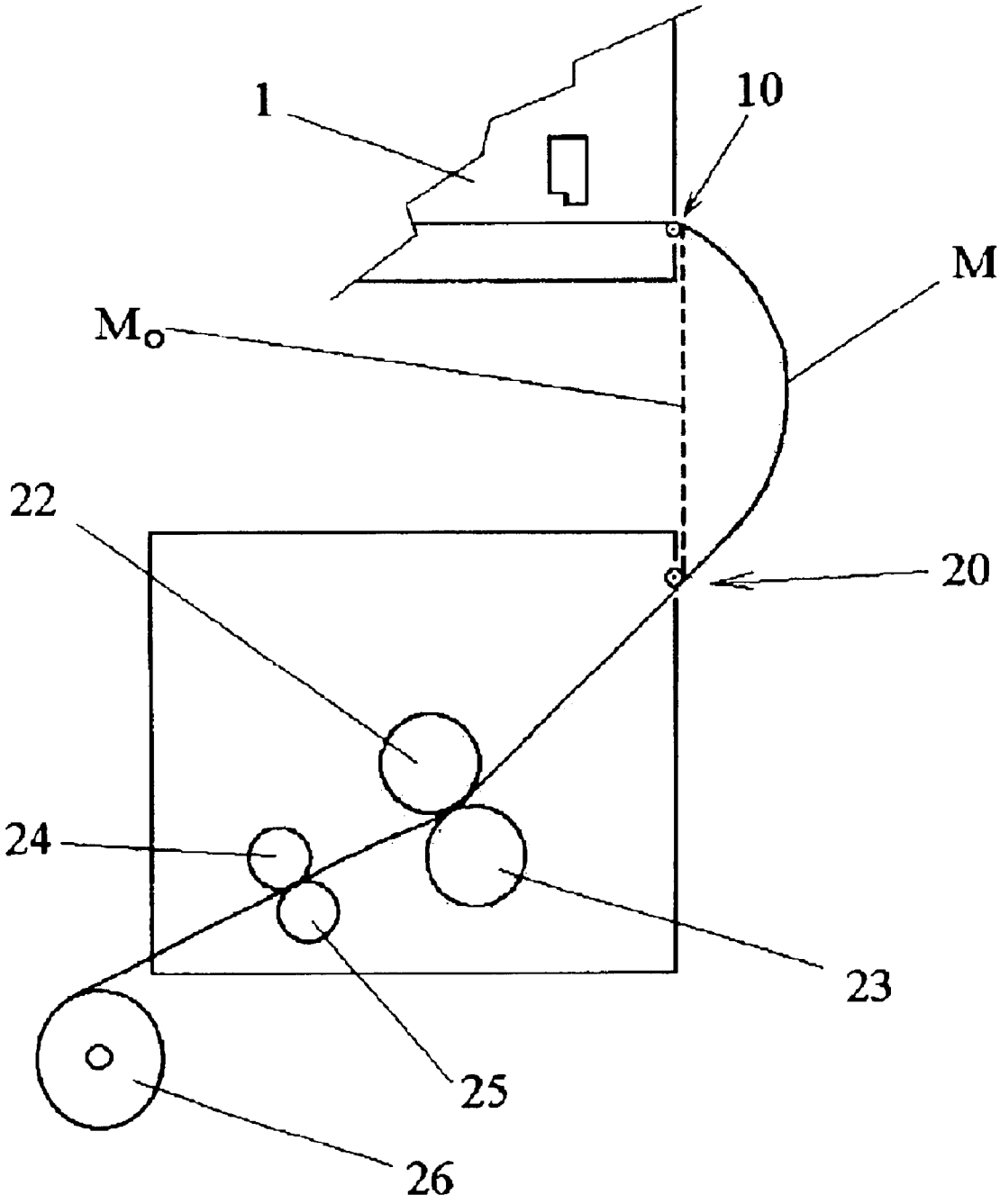
FIG. 5 is a partial view of an apparatus according to an embodiment of the invention provided with media buffer resetting means.

FIG. 5 shows in partial view an apparatus according to an embodiment of the invention, provided with means for performing an automated reset operation. The aim of the operation is to inform the control means of the apparatus that the length of media between the printer and the laminator is set at a predetermined known value; the reset operation can therefore also be considered an operation of calibration.

The apparatus of FIG. 5 is provided with means for arranging the media web tight between the printer outlet 10 and the laminator inlet 20, i.e. to reduce the media buffer to zero. It is here considered that 'buffer' is defined as any length of media that keeps it loose and tensionless between the printer outlet 10 and the laminator inlet 20; and by 'reduce the buffer to zero' it is meant to arrange the media substantially tight and under a slight tension that allows to consider its length to be equal to: a predetermined known value.

The media arranged tight and with the buffer reduced to zero is shown in FIG. 5 in dotted lines and with the reference $M_0$. In this condition, the length of media between the printhead of the printing device 1 and the lamination rolls 22,23 of the laminator 2 has a known value.

There are several possible manners to reduce the buffer to zero, and at least three particular embodiments have been foreseen, as explained below.

In the process of reducing the buffer to zero, the media is maintained stationary in the printer 1 while it is advanced in the laminator 2, such that any existing buffer is gradually reduced; the three embodiments refer to the means to determine when the media is tight.

According to a first embodiment, a clutch can be incorporated to the media take-up reel 26, such that the take-up reel pulls the media until the clutch slips; at this point, the media M is being subject to a predetermined tension which depends on the features of the clutch. The lamination rolls 22,23 and the driving rollers 24,25 are preferably maintained open during the operation.

According to a second embodiment, current sensor means are provided associated to an electric motor which powers the driving rollers 24,25 of the laminator 2: the lamination rolls 22,23 are preferably maintained open and the media is advanced by the driving rollers 24,25 until the current sensor reads a predetermined thresholds value of the current of the electric motor, indicating an increase in the torque of the motor and therefor an increase in the tension of the media M.

The third foreseen embodiment involves the use of optical methods, such as a proximity sensor as described in relation to FIG. 2, to detect when the media buffer is reduced to zero and the media M is therefore straight, or even a mechanical sensor such as the arm 7 described in relation to FIG 3.

In each case, as a consequence of the reset operation, the control means 5 (FIG. 1) of the apparatus reset the length of the media between the printhead and the lamination rolls to the known value.

A reset operation can be performed e.g. when a new roll of media is loaded in the apparatus, or when the printing and laminating have been stopped for maintenance operations or any other reason.

However, a reset operation such as described may also be performed at regular intervals during the operation of the apparatus, for example after printing each plot or after printing a predetermined number of plots.

This resetting at regular intervals prevents possible errors, e.g. due to media slippage, from adding up plot after plot, and therefore it allows a more accurate determination of the position of the leading and trailing edges of each plot and of the length of the buffer.

As a consequence, it is possible to design an apparatus that functions unattended and without losing accuracy with long rolls of media.

Reference has been made to an apparatus in which the media leaves the printer 1 through an outlet 10 and is fed to the laminator 2 through an inlet 20; however, an apparatus may also be provided with an integral housing inside which the media travels from one device to the other, and it is obvious that all what has been described in the present specification may similarly be applied to such a device.

Figure 6:
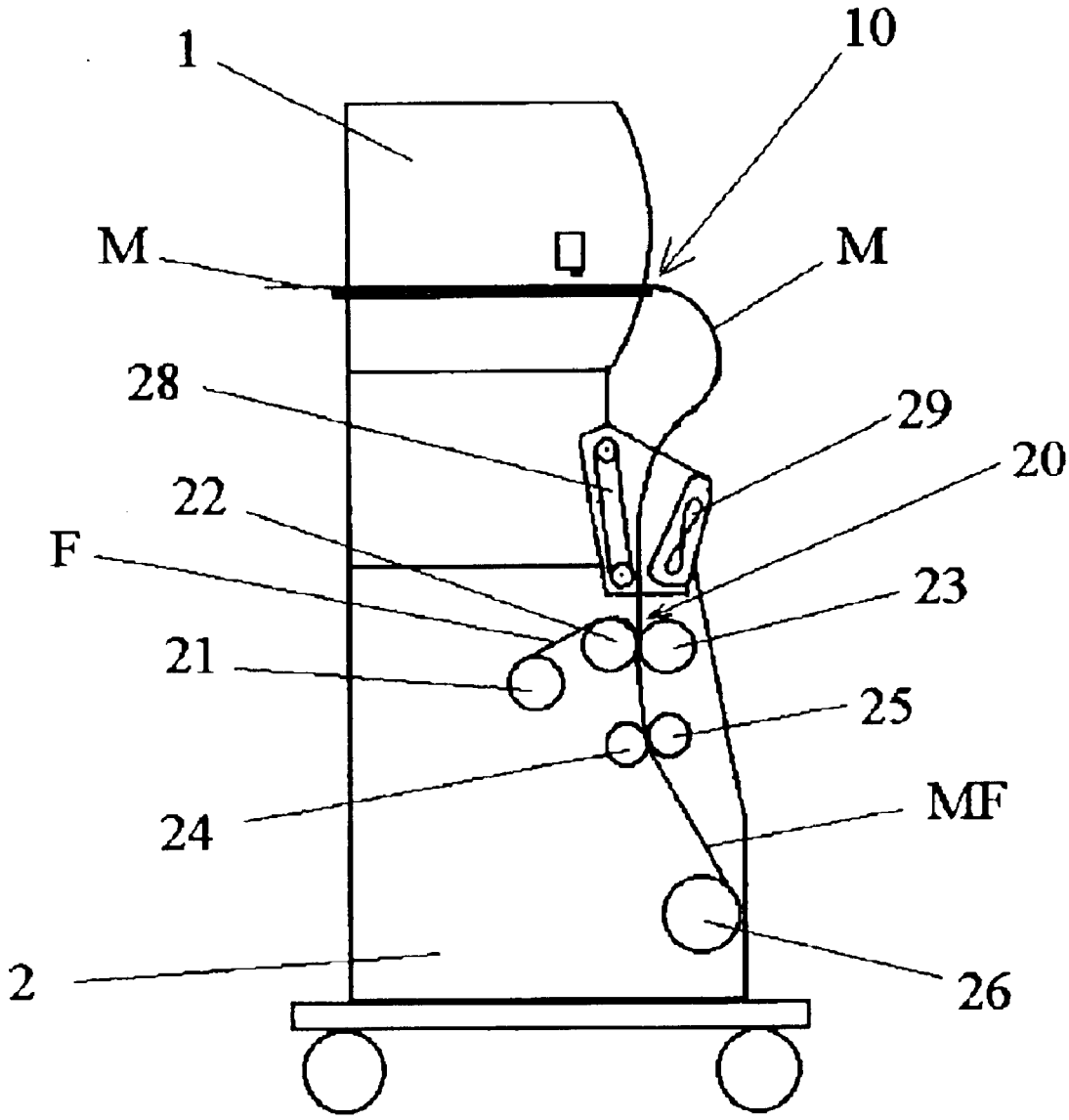
FIGS. 6 and 7 show a printing apparatus according to an embodiment of the invention slightly different from that of FIG. 1.
Figure 7:
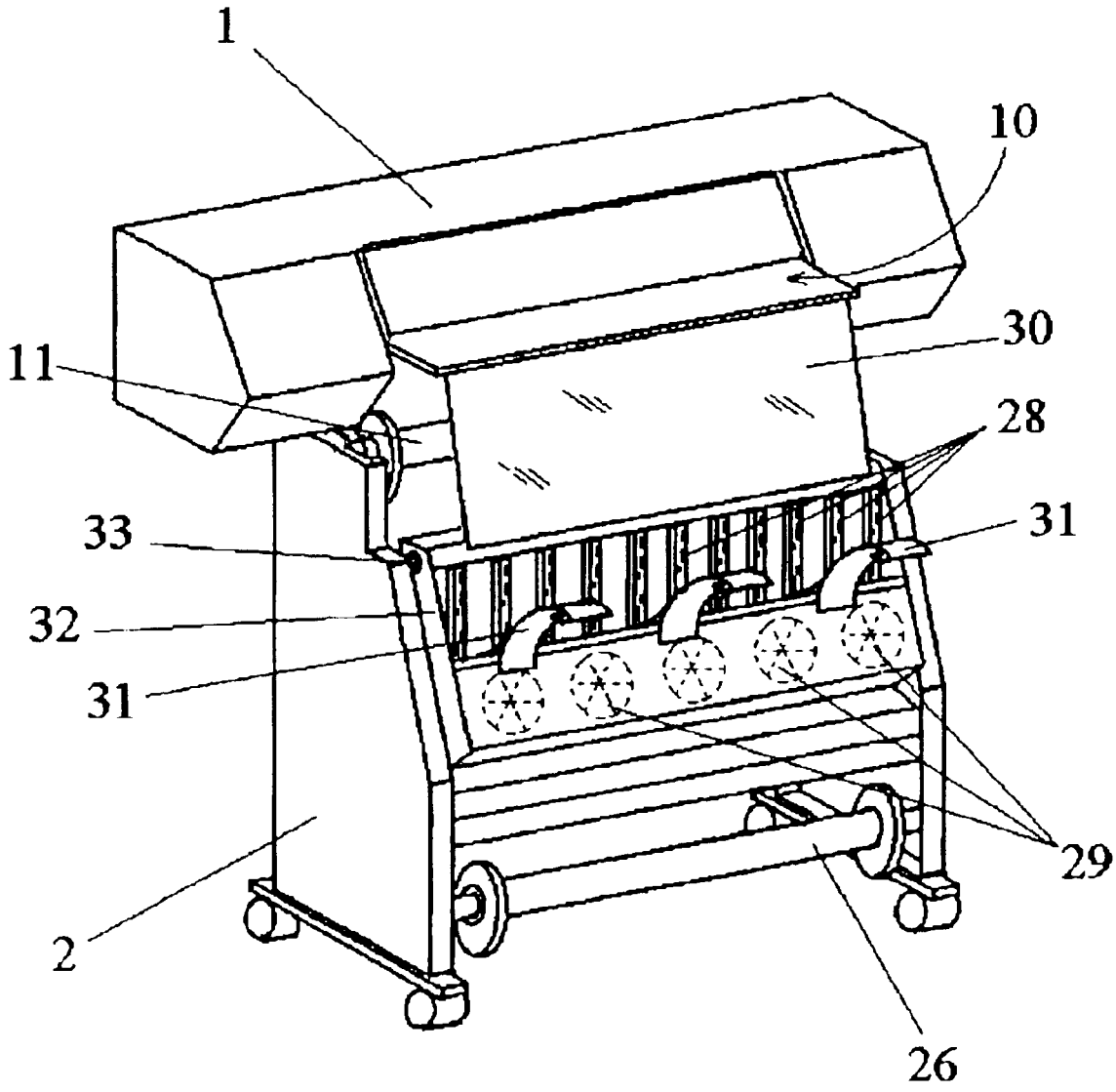

FIGS. 6 and 7 show an apparatus similar to that of FIG. 1, with a slightly different layout of the elements and also including a feeding device 28,29 for feeding the media to the laminator. Elements of this embodiment that are similar to those of the previous figures have the same reference numerals and will not be described again.

FIG. 6 is a schematic view showing the position of the feeding device, which comprises conveyor belts 28 and fans 29 arranged along the media path between the outlet 10 of the printer and the inlet 20 of the laminator.

FIG. 7 shows the apparatus in perspective without any media loaded. The figure shows a blank media reel 11, from which the media is fed to the printer 1, and also the take-up reel 26 described above.

The feeding device includes a plurality of conveyor belts 28 arranged parallel to each other and with their feed path in substantially vertical direction, and a plurality of fans 29 which are arranged side-by-side and facing the conveyor belts 28, the fans and belts being arranged on opposite sides of the media path, upstream of the laminator.

Fans 29 are shown in phantom lines in FIG. 7 because they are not visible in this perspective.

The fans 29 generate an air stream such as to urge the media towards the conveyor belts 28, and the latter are set in motion to guide the leading edge of the media with an adequate orientation.

In the example, the conveyor belts 28 are made of high-friction rubber, and they are about 19 mm wide; they are spaced about 75 mm from each other (between centres), in order to provide enough support and friction surface for the flexible media and at the same time allow air flow between the belts in the region that is not covered by the media when the latter is narrower than the maximum admitted width, thus helping reduce the air flow towards the laminator.

The conveyor belts 28 could be replaced by a different type of transport means able to drive the media by friction, such as an array of wheels with a high-friction surface, e.g. made of rubber.

Similarly, the fans 29 could be replaced by other elements, e.g. a vacuum system arranged behind the conveyor belts to create a depression to attract the media towards the belts by vacuum.

The fans system, vacuum system or other air stream generating system could be located in a different position in the apparatus, and the air stream could be conducted towards the media and the belts by means of tubing.

In order to prevent a leading edge of the media leaving the printer from missing the space between the fans and belts, the apparatus further comprises deflectors 30 and 31 arranged at either sides of the media path upstream of the fans and belts.

The deflectors allow unattended operation of the apparatus even at the beginning of a web or sheet of media; they are not needed if a user manually guides the leading edge of the media to enter the space between conveyor belts 28 and fans 29.

In the embodiment shown in FIG. 7, deflector 30 is a sheet of flexible material, such as plastic, removably mounted between the outlet 10 of the printer and the upper edge of the belts 28. Deflector 30 prevents the leading edge of the media from deviating towards the apparatus, where it could get caught in the media feed roll or in other parts of the device. The deflector 30 is removable in order to allow access to the inner parts of the apparatus, and it could be replaced by a rigid metal cover or other suitable housing element.

On the other side of the media path, a plurality of outer deflectors 31 prevent the media edge from falling outwards and missing the space between fans 29 and belts 28.

Deflectors 31 are sloped and curved and project outwards, as shown in FIG. 7, so as to conduct the media edge towards the space between the belts and fans: for this purpose, the base of the deflectors 31 is positioned on the housing of the fans, at about 50 mm from the belts 28, while the upper side of the deflectors 31 is spaced about 140 mm from the belts and the deflector 30.

Deflectors 31 are made of a plastic material including about 2% of an antistatic component, and are coated with a sheet of polypropylene about 0,5 mm thick for preventing the deflector from damaging the printed plot when they come into contact.

The conveyor belts 28 and fans 29 are arranged in a housing 32 (FIG. 7) which can be pivoted with respect to the apparatus by virtue of a hinge axis 33; this allows access to the inner part of the laminator 2 for maintenance and cleaning operations and in order to load the lamination film, if needed.

The deflectors 31 are mounted on the housing 32, and the lower edge of deflector 30 also may be removably fixed to it.

The operation of the apparatus with the fans and conveyors system will now be described.

FIGS. 8 to 12 show different steps of the feeding operation that is performed when a leading edge of the media leaves the printer and has to be fed to the laminator, for example when starting printing on a web or sheet of media.

Figure 8:
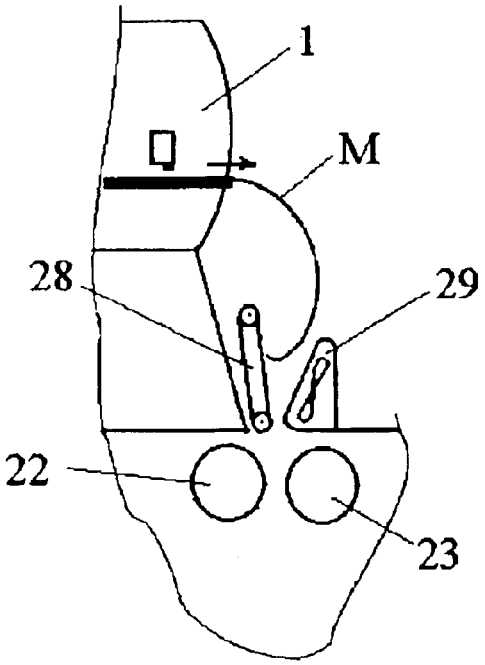
FIGS. 8 to 12 show different steps of operations performed by the feeding means of the apparatus of FIGS. 6 and 7.

In FIG. 8, a leading edge of the media M leaving the printer advances towards the laminator with a degree of curling, which will vary from case to case depending e.g. on the type of media and the density of ink in the plot.

Figure 9:
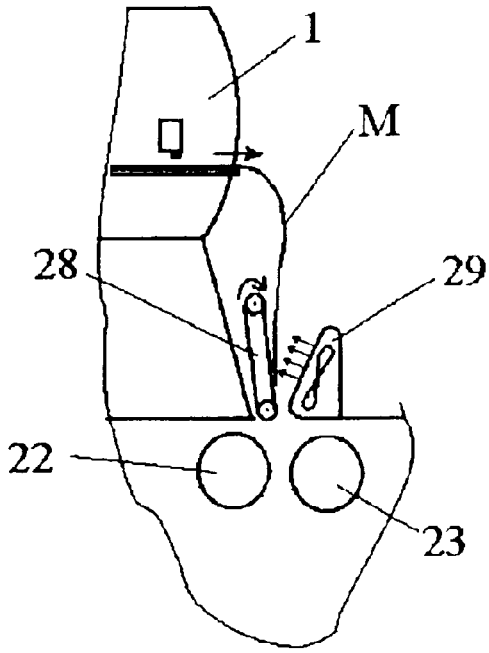

When the media edge reaches the space between the fans 29 and conveyor belts 28, the fans are powered and the belts start to advance in the direction shown by the arrows in FIG. 9, at a speed of about 100 mm/sec, thus faster than the media advance speed, such that the belts tend to pull the media edge downwards and undo the curling, and to straighten the media and exert a degree of downward pulling action thereon; this ensures a more uniform positioning of the media edge along all its width and thus avoids skew of the media when its leading edge enters the laminator.

The fans urge the media towards the belts in order to ensure enough friction between them.

Figure 10:
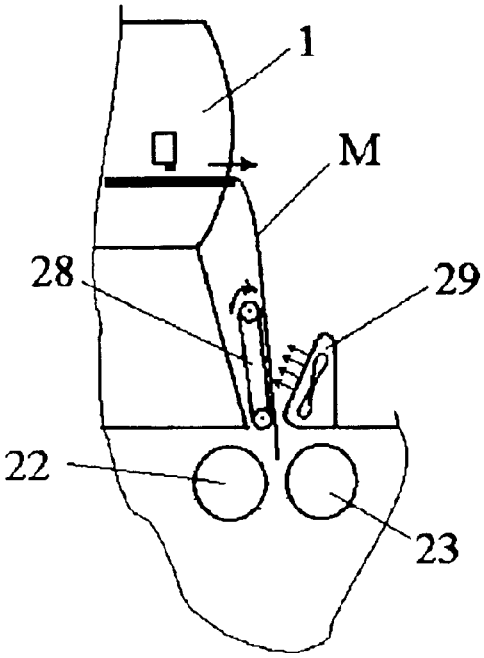
Figure 11:
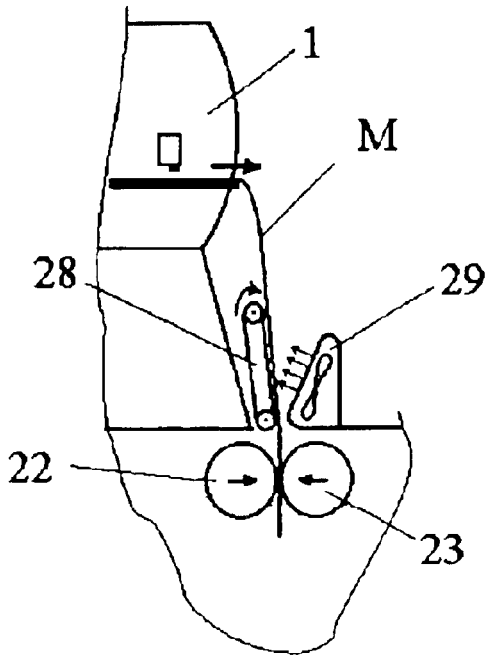

FIG. 10 shows the situation in which the leading edge of the media approaches the lamination rolls 22,23. There are then two possible ways of operation, as described hereinafter.

According to one embodiment, after the leading edge of the media travels through the laminator rolls 22,23 the rolls are closed (FIG. 11) gripping the media M and the film F, the latter not being shown in FIGS. 8 to 12 for the sake of clarity.

According to an alternative embodiment, it is also possible to close the lamination rolls before the media edge reaches them, and start laminating film without media; the conveyor belts feed the media until its leading edge enters between the lamination rolls which are already rotating.

In both cases, a resetting operation to one of the embodiments described above may be performed at this point.

The whole feeding operation can be automated, or the user can be requested to feed the leading edge of the media to the space between the conveyor belts 28 and fans 29.

Apart from working for feeding the leading edge of the media to the laminator as described, the fans 29 and belts 28 perform other functions, as will be described in the following.

Figure 12:
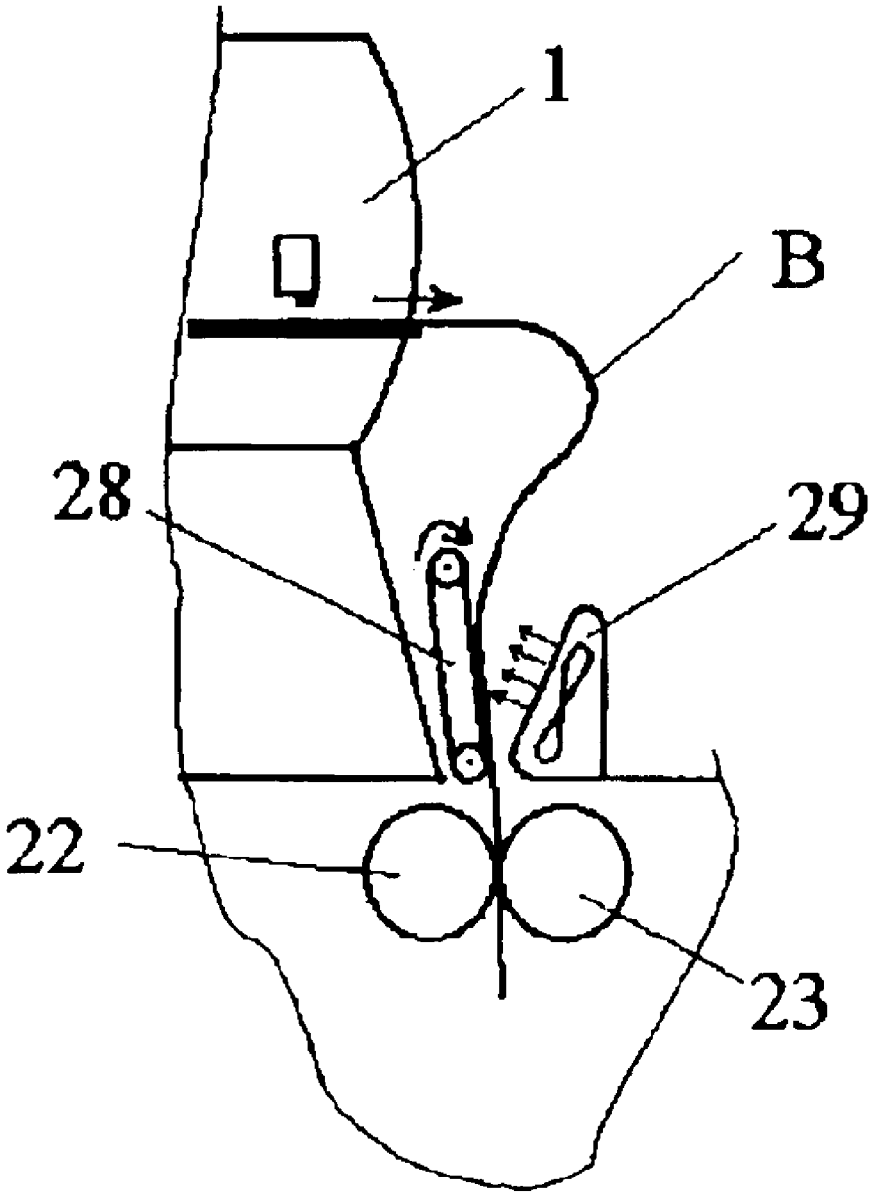

Once the media has reached the laminator, the resetting operation has been performed and the printing operation starts, as shown in FIG. 12, the conveyor belts 28 and fans 29 work to form the media buffer B in a position upstream of the feeding system 28,29: for this purpose the conveyor belts 28 and the driving rollers 24,25 of the laminator are slowed down, such that the advance of the media in the laminator is smaller than the advance of the media in the printer, and a length of media buffer is formed.

The air stream generated by the fans 29 and the friction of the media with the belts 28 force the buffer to remain upstream of the feeding system: this allows to control the shape of the buffer and also prevents the printed side of the media from contacting the surfaces of the housing of the apparatus, throughout all the printing and laminating process.

During normal operation of the apparatus, when the printer and the laminator are working on the same plot or web of media, the fans and belts also maintain the correct angle of entrance of the media to the laminator; the fans and belts may also be used to slightly slow down the media in this region (this is done by driving the belts with a speed lower than that of advance of the media in the laminator, or stopping them completely) thereby generating a slight back tension in the media before it enters the laminator: this helps the media enter the laminator free from wrinkles.

Finally, the fans may also contribute to some extent to the drying, of the printed plot before it is laminated.

The operation of the fans 29 and belts 28 is controlled by the control means of the apparatus (not shown) to be adequately synchronised with the advance of the media in the laminator, the closure of the laminator rolls 22,23 and driving rollers 24,25, and so on.

The conveyor belts 28 may be powered by means of a transmission from the driving rollers 24,25 of the laminator, or they can have an independent drive. The latter case has the advantage of easily allowing higher speeds for the belts in certain steps of operation, which is useful for avoiding skew, as explained above.

The apparatus may include sensor means to control when the leading edge of the media reaches the region of the belts and fans, or alternatively this may be estimated by counting the length of media that has left the printer.

What is claimed is:

1. A printing apparatus comprising a printer and a laminator device, in which media that advances and is printed in the printer is subsequently fed in an integrated operation to the laminator device and advanced therethrough to laminate at least part of said media, the media being laminated by applying to it a lamination film, such that the media and the film become adhered to each other, wherein the media between the printer and the laminator device is continuous and forms a loose media buffer, the apparatus further comprising synchronization means between the advance, of the media in the printer and the advance of the media in the laminator device.

2. A printing apparatus as claimed in claim 1, wherein said synchronization means comprise first counting means associated to the printer, second counting means associated to the laminator device, and control means to control the advance of the media in the laminator device in response to the readings of said first and second counting means.

3. A printing apparatus as claimed in claim 2, wherein said first and second counting means comprise encoders.

4. A printing apparatus as claimed in claim 1, wherein said synchronization means comprise buffer shape sensor means which provide a reading of a geometric variable associated with the shape of the media buffer, and control means to control the advance of the media in the laminator device in response to the reading of said buffer shape sensor means.

5. A printing apparatus as claimed in claim 1, wherein said synchronization means comprise means to provide control indicia on the printed media and means to detect said control indicia at the laminator device.

6. A printing apparatus as claimed in claim 5, wherein said control indicia are printed marks.

7. A printing apparatus as claimed in claim 1, further comprising means for performing a resetting operation of said media buffer.

8. A printing apparatus comprising a printer and a laminator device, in which media that advances and is printed in the printer is subsequently fed in an integrated operation to the laminator device and advanced therethrough to laminate at least part of said media the media being laminated by applying to it a lamination film, such that the media and the film become adhered to each other, wherein the media between the printer and the laminator device forms a loose media buffer, the apparatus further comprising synchronization means between the advance of the media in the printer and the advance of the media in the laminator device, wherein said synchronization means comprise buffer shape sensor means which provide a reading of a geometric variable associated with the shape of the media buffer, and control means to control the advance of the media in the laminator device in response to the reading of said buffer shape sensor means, and wherein said buffer shape sensor means comprise at least an arm having one end hinged to the apparatus and the other end in contact with the media buffer, and means to determine the angular position of said arm.

9. A printing apparatus comprising a printer and a laminator device, in which media that advances and is printed in the printer is subsequently fed in an integrated operation to the laminator device and advanced therethrough to laminate at least part of said media, the media being laminated by applying to it a lamination film, such that the media and the film become adhered to each other, wherein the media between the printer and the laminator device forms a loose media buffer, the apparatus further comprising synchronization means between the advance of the media in the printer and the advance of the media in the laminator, device, and further comprising:

means for performing a resetting operation of said media buffer, wherein said means for performing a resetting operation comprise means for reducing the loose media buffer to zero by arranging the media tight between the printer and the laminator device.

10. A printing apparatus as claimed in claim 9, wherein said means for reducing the loose media buffer to zero comprise means for maintaining the media stationary in the printer and advancing it in the laminator device, and means for stopping the advance of the media in the laminator device when the loose media buffer has been reduced to zero.

11. A printing apparatus as claimed in claim 10, wherein said means for stopping the advance of the media in the laminator device comprise sensor means arranged to sense the geometric shape of the media buffer.

12. A printing apparatus as claimed in claim 10, wherein said means for stopping the advance of the media in the laminator device comprise means arranged to detect a predetermined tension of the media.

13. A printing apparatus as claimed in claim 12, wherein said means arranged to detect a predetermined tension of the media comprise a clutch associated to media take-up means.

14. A printing apparatus as claimed in claim 12, wherein said means arranged to detect a predetermined tension of the media comprise an electric current sensor associated to media driving means.

15. A printing apparatus comprising a printer and a laminator device, in which media that advances and is printed in the printer is subsequently fed in an integrated operation to the laminator device and advanced therethrough to laminate at least part of said media, the media being laminated by applying to it a lamination film, such that the media and the film become adhered to each other, wherein the media between the printer and the laminator device is continuous and forms a loose media buffer, the apparatus further comprising at least a first encoder associated to the printer and at least a second encoder associated to the laminator device, and a control device to control the advance of the media in the laminator device in response to the readings of said encoders, in order to synchronize the advance of the media in the printer and the advance of the media in the laminator device.

16. A method for printing and laminating a media, comprising advancing media through a printer to print on it, feeding media that leaves the printer to a laminator device in an integrated operation such that the medium is continuous between the printed and laminator device, leaving a loose media buffer between the printer and the laminator device, and advancing said media through the laminator device to laminate at least part of said media, the media being laminated by applying to it a lamination film, such that the media and the film become adhered to each other, wherein the advance of the media in the printer and the advance of the media in the laminator device are synchronized.

17. A method as claimed in claim 16, wherein said synchronization comprises counting the media advance in the printer, counting the media advance in the laminator device, and controlling the advance of the media in the laminator device in response to the result of said countings.

18. A method as claimed in claim 16, wherein said synchronization comprises sensing the buffer shape by detecting a geometric variable associated with the shape of the buffer, and controlling the advance of the media in the laminator device in response to the determined buffer shape.

19. A method as claimed in claim 16, wherein said synchronization comprises providing control indicia on the printed media and detecting said control indicia at the laminator device.

20. A method as claimed in claim 16, further comprising the step of performing a resetting operation of said media buffer.

21. A method for printing and laminating a media, comprising advancing media through a printer to print on it, feeding media that leaves the printer to a laminator device in an integrated operation, leaving a loose media buffer between the printer and the laminator device, and advancing said media through the laminator device to laminate at least part of said media, the media being laminated by applying to it a lamination film, such that the media and the film become adhered to each other, wherein the advance of the media in the printer and the advance of the media in the laminator device are synchronized, and further comprising the step of performing a resetting operation of said media buffer wherein said resetting operation is performed at intervals.

22. A method as claimed in claim 21, comprising printing a plurality of plots on said media, wherein said resetting operation is performed before each plot is printed.

* * * * *